US005080013A

United States Patent [19]

John

[11] Patent Number: 5,080,013

[45] Date of Patent: Jan. 14, 1992

[54] CHAMBERED DOCTOR BLADE SYSTEM FOR PRINTING MACHINE INKERS

[75] Inventor: Thomas John, Augsburg, Fed. Rep. of Germany

[73] Assignee: Man Roland Druckmaschinen AG, Offenbach am Main, Fed. Rep. of Germany

[21] Appl. No.: 492,538

[22] Filed: Mar. 12, 1990

[30] Foreign Application Priority Data

Mar. 25, 1989 [DE] Fed. Rep. of Germany ..... 3909879

[51] Int. Cl.[5] ..... B41F 31/04

[52] U.S. Cl. ..... 101/366; 101/169; 118/259; 118/261; 403/292

[58] Field of Search ..... 101/366, 365, 350, 148, 101/157, 159, 169; 118/261, 259; 403/292

[56] References Cited

U.S. PATENT DOCUMENTS

| | | | |
|---|---|---|---|
| 3,046,885 | 7/1962 | Neal | 101/366 X |
| 3,384,013 | 5/1968 | King et al. | 101/366 X |
| 3,543,682 | 12/1970 | Farrow | 101/366 |
| 3,899,999 | 8/1975 | Christ et al. | 101/366 X |
| 4,009,657 | 3/1977 | Bonanno et al. | 101/366 X |
| 4,085,672 | 4/1978 | Grosart | 101/366 X |
| 4,481,883 | 11/1984 | Savart et al. | 101/365 X |
| 4,559,871 | 12/1985 | Kutzner et al. | 101/366 X |
| 4,625,643 | 12/1986 | Davis | 101/366 X |
| 4,831,927 | 5/1989 | Lin | 101/366 X |

*Primary Examiner*—Edgar S. Burr
*Assistant Examiner*—Moshe I. Cohen
*Attorney, Agent, or Firm*—Frishauf, Holtz, Goodman & Woodward

[57] ABSTRACT

To permit easy interchangeability of a doctor blade unit which could be a "throw-away" or "recyclable" item, the doctor blade unit and a carrier element (8) on the printing machine are formed with interengaging plug-and-socket connections formed, respectively, on the carrier element (8) and the rear wall (2) of the chambered doctor blade unit (1), in which the plugs can be hollow plugs or pipe stubs, secured to and projecting from the carrier element (8) snugly fitting into reception openings (13) formed in the rear wall (2) of the chambered doctor blade unit.

12 Claims, 1 Drawing Sheet

CHAMBERED DOCTOR BLADE SYSTEM FOR PRINTING MACHINE INKERS

Reference to related application, the disclosure of which is hereby incorporated by reference, assigned to the assignee of the present application:

U.S. Ser. No. 07/403,620, filed Sept. 6, 1989, BOCK et al, now U.S. Pat. No. 4,964,336.

U.S. Ser. No. 07/492,539, filed Mar. 12, 1990, JOHN, now U.S. Pat. No. 5,044,277.

FIELD OF THE INVENTION

The present application relates to inkers for printing machines, and more particularly to chambered doctor blade units which apply ink to a printing machine cylinder or roller, for example an anilox roller.

BACKGROUND

Printing machine inkers have been proposed in which a chambered unit is secured to the printing machine to be easily exchangeable thereon, see the referenced U.S. application Ser. No. 07/403,620, filed Sept. 6, 1989, BOCK et al., now U.S. Pat. No. 4,964,336. Stripping or doctoring blades, or similar stripping or doctoring elements, project from the chambered unit towards the printing machine cylinder which is to be inked. Side walls close off the chambered unit to define an ink application chamber. Customarily, printing machines have cylinders which revolve about horizontal axes.

THE INVENTION

It is an object to provide a chambered doctor blade unit which is easily exchanged, can be cheaply made, and so constructed that it can be readily attached and detached from the printing machine to form a chambered doctor blade unit which, if desired, can be replaced as a whole, simply and effectively, for example to replace the doctor blade unit with another one having new, unworn doctor blades or stripping elements.

Briefly, the printing machine has a carrier element, terminating, preferably, in a flat plate-like structure. The doctor blade unit is connected to this carrier element by a severable interengaging plug-and-socket connection, for example by bores extending in or through the rear wall of the chambered doctor blade unit and fitting over projecting pins or bolts. Rather than using solid pins or bolts, the projections can be tube elements or stubs which, at the same time, form ink supply or ink supply-and-recirculating connections to suitable ink supply hoses or the like on the printing machine.

In accordance with a preferred feature of the invention, the doctor blade unit is a single unitary element, comprising the box-like structure including the side walls; this single element can be a plastic injection molding, a casting, or a machine part, so that, in effect, a single-use structure can be obtained.

The simple attachment arrangement by a plug-and-socket connection or, generally, an interengaging projection-and-recess connection, permits simple exchange of the chambered doctor blade unit; and, further, lateral sealing between the forward region of the stripping or doctor blade portions of the unit and the side walls does not pose problems.

The referenced application Ser. No. 07/492,539, filed Mar. 12, 1990, JOHN, describes an arrangement of side walls which have a predetermined inclination resulting in particularly effective elimination of lateral leakage.

DRAWINGS

FIG. 1 is a schematic cross-sectional side view through a doctor blade unit attached to a carrier structure; and FIG. 2 is a fragmentary end view of the chambered doctor blade unit of FIG. 1, looking in the direction of the arrow II in FIG. 1.

DETAILED DESCRIPTION

Figure 2:
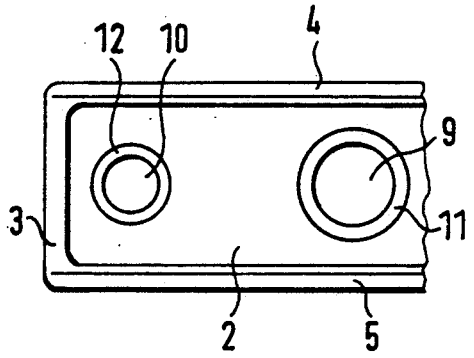

The chambered doctor blade unit 1 has a back wall 2, two side walls 3 and two stripping elements 4, 5, which can be doctor blades or formed on the unit itself. The portions 2, 3, 4 and 5 define an inner chamber 6 which is open towards a printing machine roller or cylinder 7, for example an anilox roller.

In accordance with a preferred feature of the invention, the unit 1 is a single unitary structure, made, for example, in form of a casting, by deformation from a single piece of material, by milling, or as an injection molding. The chambered unit 1 is preferably made of metal, but may also be made of a hard, wear-resistant plastic.

Ink is supplied to the chambered doctor blade unit by an ink supply line 9; excess ink can be recirculated through an ink drainage hole 10.

In accordance with a feature of the invention, the ink supply line 9 terminates in a projecting hollow sleeve or support pin 11, fitted securely into the carrier element 8. The carrier element 8 is part of the printing machine and located thereon in movable manner, so that the entire doctor blade unit 1, together with the carrier 8, can be tipped or tilted away from engagement with the anilox roller 7. The forward end of the connecting sleeve or tube stub 11 projects beyond the carrier element 8. Preferably, carrier element 8 terminates in a wall or plate portion, fitting against the rear surface of the rear wall 2 of the doctor blade unit 1. The stub 11 fits snugly in a bore 13, so positioned and dimensioned that the doctor blade unit 1 can be pushed on the pin 11, and a similar pin 12, and is held on the carrier 8 by frictional engagement of the pin or stub 11, 12 in the respective bore 13 of the doctor blade unit.

Figure 1:
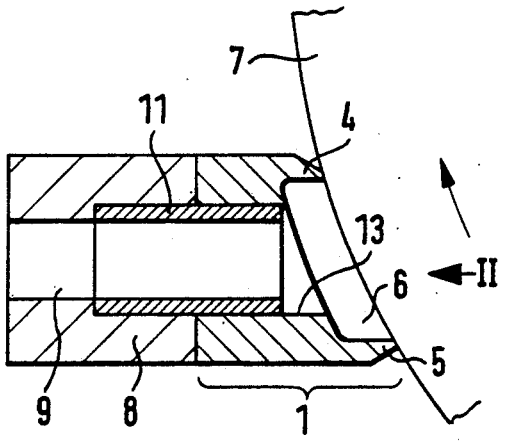

A hollow pipe stub 12 is fitted in a prolongation of the ink return or overflow line 10, also extending beyond the carrier unit 8, similarly to the stub 11, as shown in FIG. 1. Carrier 8 is retained between the side walls of the printing machine and movable such that the stripping elements 4, 5 can be engaged with the anilox roller 7, or disengaged therefrom.

At least two projecting elements 11, for example pipe stubs as shown in FIG. 1, are provided on the carrier 8, located essentially in a central portion of the chambered doctor blade unit 1. The stubs 12, for ink recirculation, are preferably located closer to the side walls 3 as seen in FIG. 2. Some doctor blade units do not require ink circulating within the chamber; for such units, the hollow stub 12 can be replaced by solid pins or bolts.

In accordance with a preferred feature of the invention, the stubs, pins or bolts are circular in cross section; this is not a necessity, however, and they can be rectangular or square as well, or otherwise polygonal.

Various changes and modifications may be made within the scope of the inventive concept.

I claim:

1. In an inker for a printing machine, to apply ink to a printing machine roller or cylinder (7), a chambered doctor blade unit (1) having an open box-like structure defining an ink chamber (6);

an upper and a lower doctor or stripping means (4, 5) facing the printing machine cylinder or roller (7), a rear wall (2) and side walls (3) laterally defining said ink chamber (6); and wherein the printing machine comprises a carrier element (8) facing the rear wall (2) of said doctor blade unit (1) and supporting said open, box-like structure;

an ink supply line (9) coupled to the carrier element; and wherein severable, interengaging plug-and-socket connection means (11, 12, 13) are formed, respectively, on said carrier element and said rear wall (2) of the chambered doctor blade unit for severably coupling said doctor blade unit to the carrier element;

wherein said plug-and-socket means comprises at least one hollow plug or stub (12); and wherein said ink supply line is coupled to the carrier element and is in fluid communication with said ink chamber.

2. The inker of claim 1, wherein the ink supply line (9) coupled to the carrier element (8) is in fluid communication with said hollow plug or stub, said hollow plug or stub being in fluid communication with the interior of said ink chamber (6).

3. The inker of claim 2, further including an ink return or circulating line (10) coupled to said carrier element; and wherein at least two hollow plugs or stubs (11, 12) are provided, one of said hollow plugs or stubs being connected to the ink supply line (9) and another one (12) of said hollow plugs or stubs being connected to the ink return or circulating line (10) coupled to said carrier element (8).

4. The inker of claim 1, wherein the plug element of the interengaging plug-and-socket means is secured to the carrier element (8), and the rear wall (2) of the doctor blade unit is formed with a receiving opening (13) snugly receiving said plug element.

5. The inker of claim 4, wherein said plug element comprises a pipe stub extending essentially entirely through the rear wall (2) of the chambered doctor blade unit.

6. The inker of claim 1, wherein the carrier element (8) comprises a flat, plate-like surface fitting against said rear wall (2) of the doctor blade unit (1).

7. In an inker for a printing machine, to apply ink to a printing machine roller or cylinder (7), a chambered doctor blade unit (1) having an open box-like structure defining an ink chamber (6);

an upper and lower doctor or stripping means (4, 5) facing the printing machine cylinder or roller (7), a rear wall (2) and side walls (3) laterally defining said ink chamber (6); and wherein the printing machine comprises a carrier element (8) facing the rear wall (2) of said doctor blade unit (1) and supporting said open, box-like structure;

an ink supply line (9) coupled to the carrier element; and wherein said open box-like structure comprising, a single unitary structural element; and severable, interengaging plug-and-socket connection means (11, 12, 13) are formed, respectively, on said carrier element and said rear wall (2) of the chambered doctor blade unit for severably coupling said doctor blade unit to the carrier element;

wherein said plug-and-socket means comprises at least one hollow plug or stub (12); and wherein said ink supply line is coupled to the carrier element and is in fluid communication with said ink chamber.

8. The inker of claim 7, wherein the ink supply line (9) coupled to the carrier element (8) is in fluid communication with said hollow plug or stub, said hollow plug or stub being in fluid communication with the interior of said ink chamber (6).

9. The inker of claim 8, further including an ink return or circulating line (10) coupled to said carrier element; and wherein said at least two hollow plugs or stubs (11, 12) are provided, one of said hollow plugs or stubs being connected to the ink supply line (9) and another one (12) of said hollow plugs or stubs being connected to an ink return or circulating line (10) coupled to said carrier element (8).

10. The inker of claim 8, wherein the plug element of the interengaging plug-and-socket means is secured to the carrier element (8), and the rear wall (2) of the doctor blade unit is formed with a receiving opening (13) snugly receiving said plug element.

11. The inker of claim 7, wherein said plug element comprises a pipe stub extending essentially entirely through the rear wall (2) of the chambered doctor blade unit.

12. The inker of claim 7, wherein the carrier element (8) comprises a flat, plate-like surface fitting against said rear wall (2) of the doctor blade unit (1).

* * * * *